US010112121B2

(12) United States Patent
Tiefel et al.

(10) Patent No.: US 10,112,121 B2
(45) Date of Patent: Oct. 30, 2018

(54) TOY ASSEMBLY THAT CONVERTS BETWEEN A SPHERICAL SHAPE AND A FLYING DISC SHAPE

(71) Applicant: Tucker International LLC, Voorhees, NJ (US)

(72) Inventors: Simeon E. Tiefel, Siloam Springs, AR (US); Jack S. Lovewell, Kunkletown, PA (US); Michael J. Goldman, Delran, NJ (US); Mark A. Adkins, East Brunswick, NJ (US)

( * ) Notice: Subject to any disclaimer, the term of this patent is extended or adjusted under 35 U.S.C. 154(b) by 0 days.

(21) Appl. No.: 15/158,787

(22) Filed: May 19, 2016

(65) Prior Publication Data

US 2016/0346628 A1 Dec. 1, 2016

Related U.S. Application Data

(60) Provisional application No. 62/167,721, filed on May 28, 2015.

(51) Int. Cl.
*A63H 33/18* (2006.01)
*A63H 33/00* (2006.01)

(52) U.S. Cl.
CPC ..... *A63H 33/18* (2013.01); *A63H 33/003* (2013.01)

(58) Field of Classification Search
CPC ... A63H 33/003; A63H 33/3318; A63H 33/18
USPC ..... 473/588; 446/46, 486, 487
See application file for complete search history.

(56) References Cited

U.S. PATENT DOCUMENTS

| | | | |
|---|---|---|---|
| 2,952,460 | A | 9/1960 | Ellis |
| 2,968,121 | A | 1/1961 | Pearson, Jr. et al. |
| 3,113,396 | A | 12/1963 | Collins |
| 3,218,071 | A | 11/1965 | Eugene |
| 3,758,985 | A | 9/1973 | Heisler |
| 4,135,325 | A | 1/1979 | Lehman |
| 4,196,882 | A | 4/1980 | Rognon |
| 4,607,875 | A | 8/1986 | McGirr |
| 4,790,714 | A | 12/1988 | Schnapp |
| 4,794,024 | A | 12/1988 | Crowell et al. |
| 4,955,841 | A | 9/1990 | Pastrano |
| 5,090,569 | A | 2/1992 | Nissen et al. |
| 5,096,751 | A | 3/1992 | Duchek |

(Continued)

FOREIGN PATENT DOCUMENTS

EP 1992391 A1 * 11/2008 ..... A63H 33/18

*Primary Examiner* — Melba Bumgarner
*Assistant Examiner* — Laura L Davison
(74) *Attorney, Agent, or Firm* — LaMorte & Associates P.C.

(57) ABSTRACT

A toy assembly that is configurable between a ball shape and a disc shape. When compressed into a disc shape, an air foil configuration is achieved that enables the toy assembly to achieve stable flight. A first plurality of body flaps radially extend from a first hub to create a first hemispherical subassembly. The opposing second hemispherical subassembly is created using a second hub and a second plurality of body flaps. A resilient ring is engaged by all of the body flaps. The resilient ring binds the two hemispherical subassemblies together. A temporary connector is coupled to the first hub and to the second hub. The temporary connector temporarily interconnects the first hub and the second hub for a period of time after the first hub and the second hub are pressed together.

16 Claims, 8 Drawing Sheets

(56) References Cited

U.S. PATENT DOCUMENTS

| | | | |
|---|---|---|---|
| 5,123,869 | A | 6/1992 | Schipmann |
| 5,263,760 | A | 11/1993 | Sohol |
| 5,381,990 | A | 1/1995 | Belokin et al. |
| 5,511,752 | A | 4/1996 | Trethewey |
| 5,797,815 | A | 8/1998 | Goldman et al. |
| D434,457 | S | 11/2000 | Goldman et al. |
| D441,107 | S | 4/2001 | Okuda |
| 6,863,588 | B1 | 3/2005 | Chu |
| 6,896,577 | B1 | 5/2005 | Feng |

* cited by examiner

TOY ASSEMBLY THAT CONVERTS BETWEEN A SPHERICAL SHAPE AND A FLYING DISC SHAPE

BACKGROUND OF THE INVENTION

1. Field of the Invention

In general, the present invention relates to toy objects that are spring biased in an expanded configuration, yet can be temporarily configured into a collapsed configuration. More particularly, the present invention relates to thrown toy objects, such as balls, that can be temporarily pressed into a collapsed configuration, wherein the thrown toy pops back into an expanded configuration a short time later.

2. Description of the Prior Art

The prior art is replete with various types of toys that are intended to be thrown. Prominent among such toys are balls and discs. It therefore is not surprising that toy manufacturers eventually combined the features of both a ball and a disc into a single throwing toy.

It is for this reason that collapsible ball throwing toys were first introduced into the toy market. Collapsible ball throwing toys are balls, or similar spherically shaped objects, that are comprised of an upper hemisphere and a lower hemisphere. The upper hemisphere and the lower hemisphere are joined together with hinged connections along a common equatorial joint. Due to the hinged connections between the upper hemisphere and the lower hemisphere, the upper and lower hemispheres of the ball can be collapsed flat against each other. When the upper and the lower hemispheres of the toy are collapsed against each other, the toy has the general configuration of a disc. Accordingly, the collapsible ball throwing toy can be configured either as a ball or as a disc, depending upon whether or not the toy is compressed.

As the upper and lower hemispheres of the toy are collapsed into a flat configuration, the diameters of the hemispheres expand. To accommodate this expansion, the upper and lower hemispheres of the toy are slotted. When the toy is fully expanded into its ball shape, the slots are closed and the toy has a continuous external surface. However, when the toy is flattened into a disc, the slots open and expand, giving the disc a daisy configuration. A typical daisy configuration of a collapsible ball throwing toy can be seen by referencing U.S. Pat. No. Des 434,457 to Goldman, entitled Collapsible Toy and U.S. Pat. No. 6,863,588 to Chu, entitled Collapsible Throwing Toy And Its Associated Method Of Manufacture.

In the prior art, collapsible ball throwing toys typically have some sort of biasing element that biases the collapsible ball throwing toy into its expanded, ball-like configuration. For example, in U.S. Pat. No. 5,797,815 to Goldman, entitled Pop-Open Throwing Toy With Controllable Opening Delay And Method Of Operating Same, a collapsible ball throwing toy is shown that has an internal coil spring. The coil spring biases apart the upper and lower hemispheres of the toy. The collapsible ball throwing toy can be temporarily configured like a disc by compressing the internal coil spring and resisting the bias of the coil spring with a momentary suction cup connection between the upper and lower hemispheres. As soon as the momentary suction cup connection fails, the internal coil spring pops the collapsible ball throwing toy back into its expanded ball-like configuration.

In U.S. Pat. No. 4,955,841 to Pastrano, entitled Disc-Shaped Throwing Toy, a collapsible ball throwing toy is disclosed. The collapsible ball throwing toy is shaped like a polyhedron. The collapsible ball throwing toy has an upper and lower hemisphere joined with a hinged connection along an equatorial joint. When compressed, the hemispheres flatten along lines in the polyhedral pattern and expand at the equatorial joint. Due to the hinged connection at the equatorial joint, the upper and lower hemispheres can fold flat against each other. However, once a compressing force is removed, the memory of the material used to make the polyhedral configuration causes both hemispheres to slowly return to their expanded shapes. As such, the collapsible ball throwing device can be flattened and thrown. After being thrown, the collapsible ball throwing device slowly returns to its expanded spherical shape. This prior art design, therefore, lacks the desired sudden transition between a collapsed condition and an expanded condition that other prior art versions of a collapsible ball throwing toy embody.

In the manufacturing of prior art collapsible ball throwing toys, one of the controlling costs is how to form the biasing mechanism that biases the toy into its expanded form. If a coil spring is used, there is the cost of the coil spring and the configurations needed to retain the coil spring. If the shell of the collapsible ball throwing toy is used as the biasing mechanism, a complicated shell configuration must be used that greatly increases the costs involved in tooling and assembling the toy. Furthermore, it is desirable that the collapsible ball throwing toy suddenly pop between its flat configuration and its expanded configuration. The collapsible ball throwing toy must therefore have a strong biasing mechanism and an equally strong temporary connecting mechanism that temporarily resists the biasing mechanism. Such connecting mechanisms also add significantly to the cost of manufacture.

Another disadvantage inherent in prior art designs is that when the collapsible ball throwing type is collapsed, it becomes disc shaped. However, the disc shape is not particularly aerodynamic. Furthermore, the disc shape lacks the air foil design that enables real toy flying discs, such as a Frisbee®, to fly well.

A need therefore exists for a collapsible throwing toy that can be modified in its construction so that it forms a more perfect airfoil shape when compressed. In this manner, the collapsible throwing toy can fly further and straighter than prior art configurations. This need is met by the present invention as described and claimed below.

SUMMARY OF THE INVENTION

The present invention is a toy assembly that is configurable between a ball shape and a disc shape. The toy assembly is biased into its ball shape, but can be temporarily compressed into a disc shape for throwing. When compressed into a disc shape, an air foil configuration is achieved that enables the toy assembly to achieve stable flight while traveling long distances.

The toy assembly has a first hub. A first plurality of body flaps radially extend from the first hub. The first plurality of body flaps are coupled to the first hub with a first set of hinge joints. The first hub and first plurality of body flaps create a first hemispherical subassembly.

The opposing second hemispherical subassembly is created in a similar manner. A second hub is provided. A second plurality of body flaps radially extend from the second hub. The second plurality of body flaps are coupled to the second hub with a second set of hinge joints.

The two hemispherical subassemblies do not directly interconnect. Rather a resilient ring is provided. The resilient ring is engaged by all of the first plurality of body flaps and all of the second plurality of body flaps. The resilient ring binds the two hemispherical subassemblies together and biases the first plurality of body flaps and the second plurality of body flaps into a ball shape.

Inside the toy assembly, a temporary connector is coupled to the first hub and to the second hub. The temporary connector temporarily interconnects the first hub and the second hub for a period of time after the first hub and the second hub are pressed together. When the first hub and the second hub are pressed together, the toy assembly embodies its disc shape. When the temporary connector releases, the toy assembly pops back suddenly into its ball shape.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention can be embodied into many shapes, such as the elongated shape of a football, only one exemplary embodiment is illustrated. The exemplary embodiment shows the present invention embodied as a round ball. This embodiment is selected to represent one of the best modes contemplated for the invention. However, the embodiment is merely exemplary and should not be considered a limitation on the claims.

Figure 1:
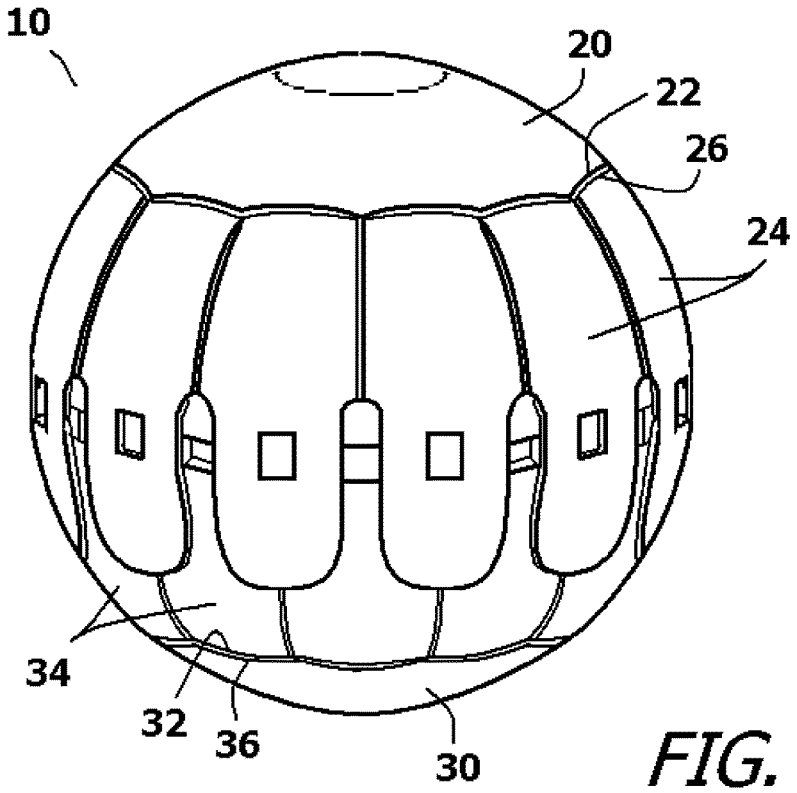
FIG. 1 is a perspective view of an exemplary embodiment of a toy assembly in its spherical shape.
Figure 2:
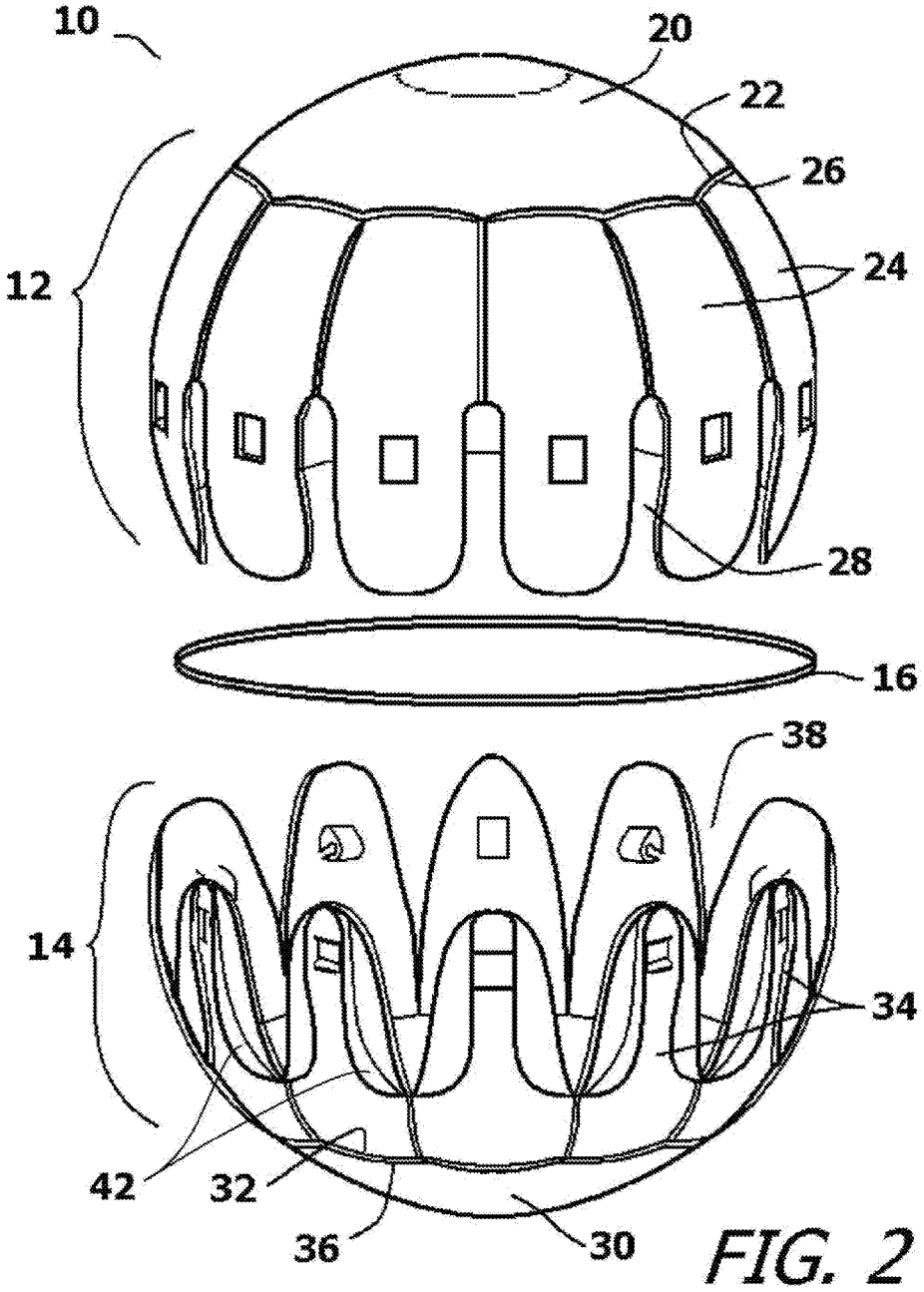
FIG. 2 is an exploded view of the exemplary embodiment of FIG. 1.

Referring to FIG. 1 and FIG. 2, there is shown a toy assembly 10 in its expanded spherical shape. The toy assembly 10 is comprised of two hemispherical subassemblies 12, 14. Both hemispherical subassemblies 12, 14 do not directly connect to each other. However, each of the hemispherical subassemblies 12, 14 engages a common resilient ring 16. As such, the resilient ring 16 binds the hemispherical subassemblies 12, 14 together.

The hemispherical subassemblies 12, 14 both are generally hemispherical in shape. However, the first hemispherical subassembly 12, has a slightly larger radius of curvature than does the second hemispherical subassembly 14. As such, when assembled together, the first hemispherical subassembly 12 overlaps sections of the second hemispherical subassembly 14.

The first hemispherical subassembly 12 has a first hub 20. The first hub 20 is curved and has a multi-sided peripheral edge 22 that follows a polygonal shape. A plurality of long flaps 24 are attached to the peripheral edge 22 of the first hub 20, wherein one of the long flaps 24 is attached to straight sections between salient points. The long flaps 24 are attached to the straight sections along the peripheral edge 22 at hinged connections 26. The hinge connections 26 can be mechanical hinges. However, in the preferred embodiment, the first hub 20 and the long flaps 24 are preferably molded together as an integral piece. In such a manufacturing scenario, the hinged connections 26 are living hinges created by thinned sections of the molded plastic.

Likewise, the second hemispherical subassembly 14 has a second hub 30. The second hub 30 is curved and has a multi-sided peripheral edge 32 that follows a polygonal shape. A plurality of short flaps 34 are attached to the peripheral edge 32 of the second hub 30, wherein one of the short flaps 34 is attached to straight sections between salient points. The short flaps 34 are attached to the straight sections along the peripheral edge 32 at hinge connections 36. The hinge connections 36 can be mechanical hinges. However, in the preferred embodiment, the second hub 30 and the short flaps 34 are preferably molded together as an integral piece. In such a manufacturing scenario, the hinged connections 36 are living hinges created by thinned sections of the molded plastic.

The long flaps 24 and the short flaps 34 are both curved. The curved length of the long flaps 24 is longer than the curved length of the short flaps 34. There are spaces 28 between the various long flaps 24. Likewise, there are spaces 38 between the various short flaps 34. When in its spherical configuration, the long flaps 24 overlap the short flaps 34, wherein the long flaps 24 are aligned over the spaces 38 between the short flaps 34. As will later be explained in more detail, both the long flaps 24 and the short flaps 34 engage the same resilient ring 16. It is the resilient ring 16 that biases the long flaps 24 and the short flaps 34 into the spherical configuration of the toy assembly shown in FIG. 1.

Figure 3:
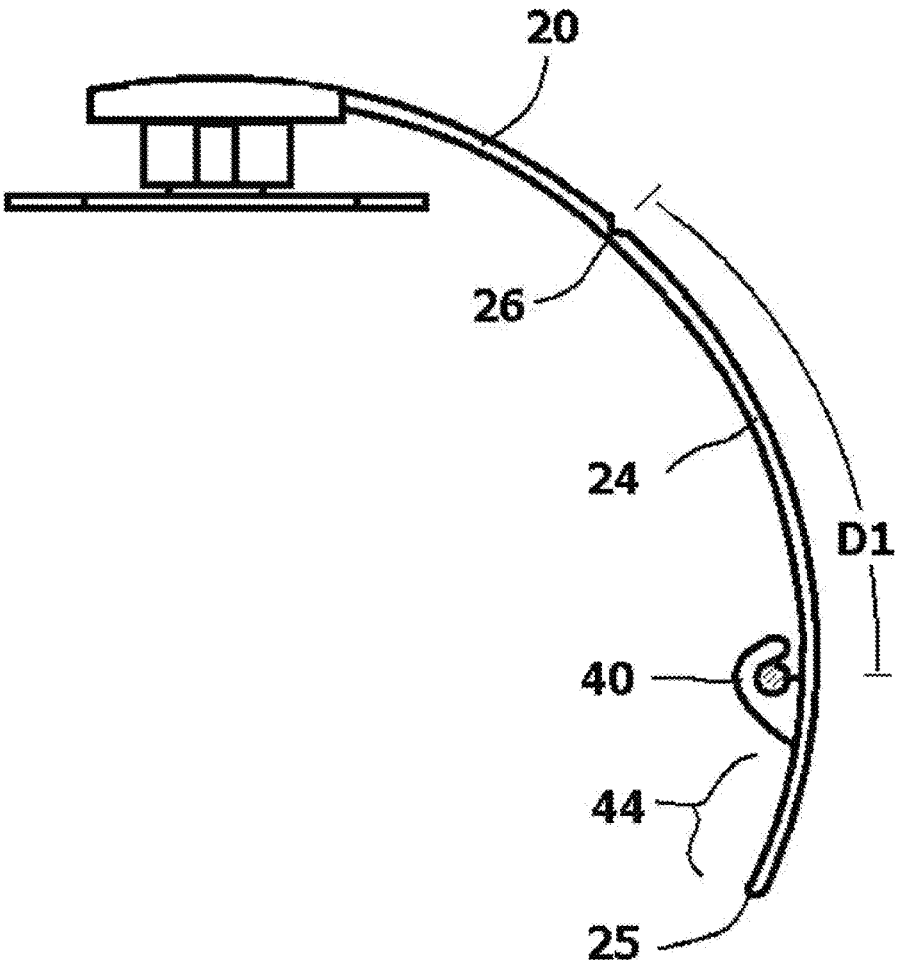
FIG. 3 is a fragmented enlarged view of a flap from the first hemispherical subassembly.

Referring to FIG. 3 in conjunction with FIG. 2, it can be seen that a hook structure 40 is formed on the concave side of each of the long flaps 24. The hook structure 40 is formed a distance D1 from the hinge connection 26. This position is approximately between one-half and one-third down the long flap 24 from the free end 25 of the long flap 24. The hook structures 40 pass into the spaces 38 between the short flaps 34, therein enabling the long flaps 24 to lay flush against the short flaps 34. The short flaps 34 may have depressions 42 on their exterior that are sized to receive the overlap of the long flaps 24. In this manner, the exterior of the toy assembly 10 remains smooth and spherical as the long flaps 24 overhang the short flaps 34.

Each long flap 24 has an overhang section 44 that extends from the hook structure 40 to the free end 25 of the long flap 24. The hook structure 40 is sized and shaped to receive and retain the resilient ring 16 that extends near the equator within the toy assembly 10.

Figure 4:
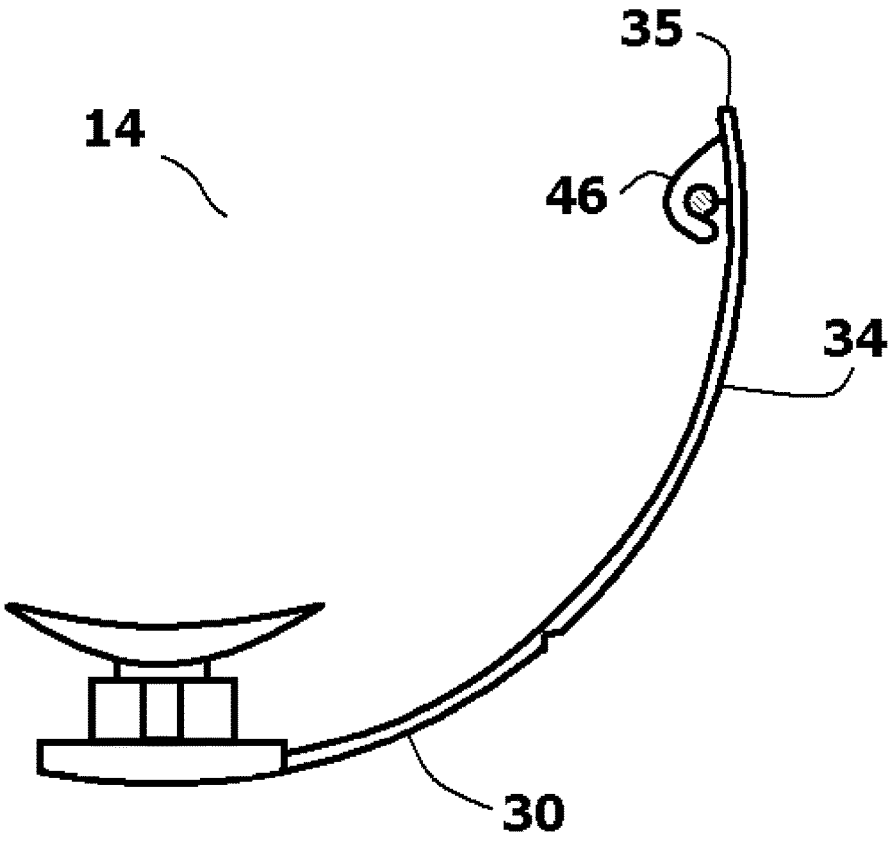
FIG. 4 is a fragmented enlarged view of a flap from the second hemispherical subassembly.

Referring to FIG. 4 in conjunction with FIG. 2, it can be seen that a hook structure 46 is also formed on the concave side of each of the short flaps 34. The hook structure 46 is formed near the free end 35 of the short flaps 34. The hook structure 46 is sized and shaped to receive and retain the resilient ring 16. The distance along each short flap between the hinge connection 36 and the hook structure 46 is equal to the distance along each of the long flaps 24 between its hinge connection 26 and the hook structure 40. As such, when the toy assembly 10 is compressed, the long flaps 24 and the short flaps 34 expand the resilient ring 16 to the same degree and the resilient ring 16 remains circular, even though it is expanded.

Figure 5:
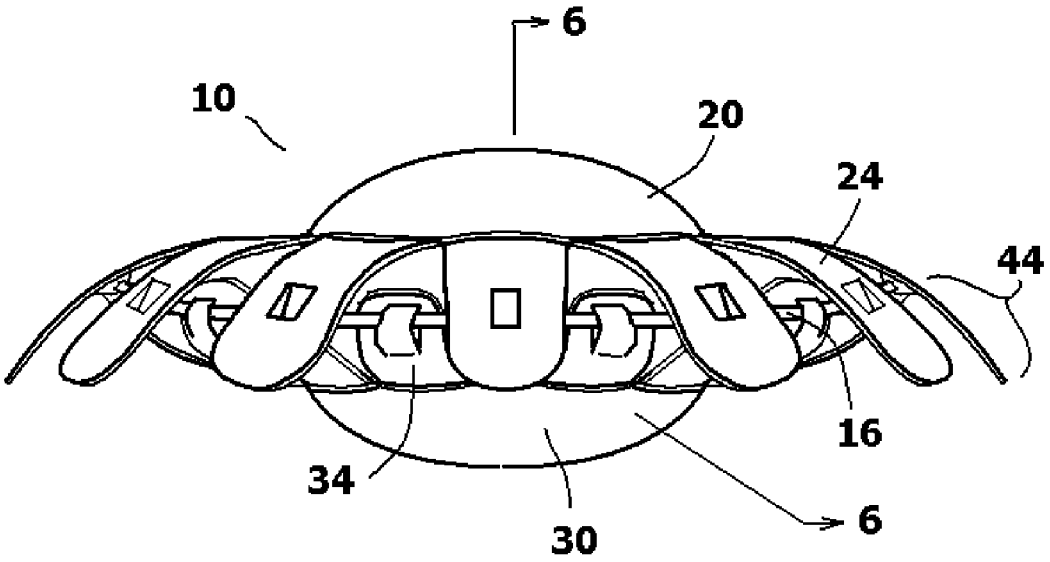
FIG. 5 is a perspective view of the toy assembly configured into its flying disc shape.
Figure 6:
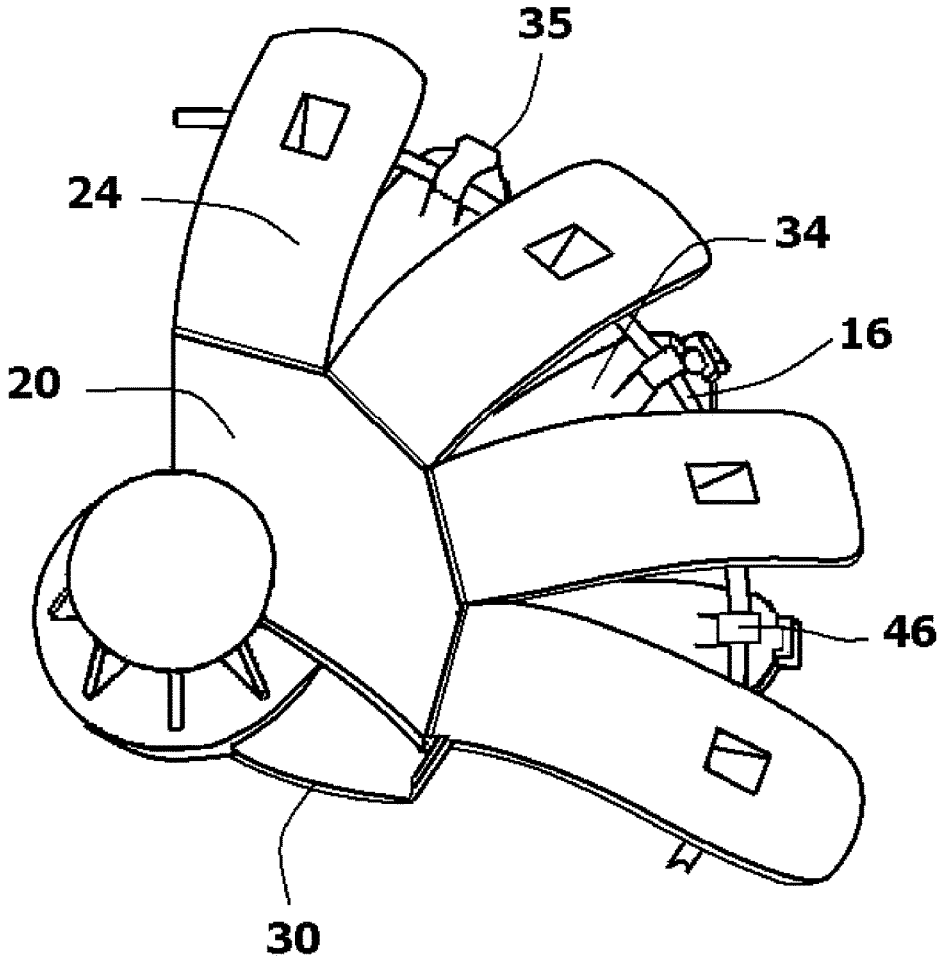
FIG. 6 is a fragmented perspective view of the embodiment of FIG. 5, viewed along section line 6-6.

Referring to FIG. 5 and FIG. 6, it will be understood that the toy assembly 10 is capable of deforming from the shown expanded spherical shape (FIG. 1) to a compressed disc shape (FIGS. 5&6). To compress the toy assembly 10, the first hub 20 is compressed toward the second hub 30. This causes the long flaps 24 and the short flaps 34 to radially flare outward in opposition to the force exerted by the resilient ring 16. Since the long flaps 24 are longer than the short flaps 34, it can be seen that the long flaps 24 flare out further than do the short flaps 34. More particularly, the overhang section 44 of the long flaps 24 radially extend from the compressed toy assembly 10 well beyond the free ends 35 of the short flaps 34. The overhang sections 44 of the long flaps 24 are curved, as is the entire length of the long flaps 24. The curved overhang sections 44 create a circular airfoil shape akin to a more traditional flying disc. Accordingly, the airfoil shape enables the toy assembly 10 to fly like a traditional flying disc when thrown with a spin through the air.

Figure 7:
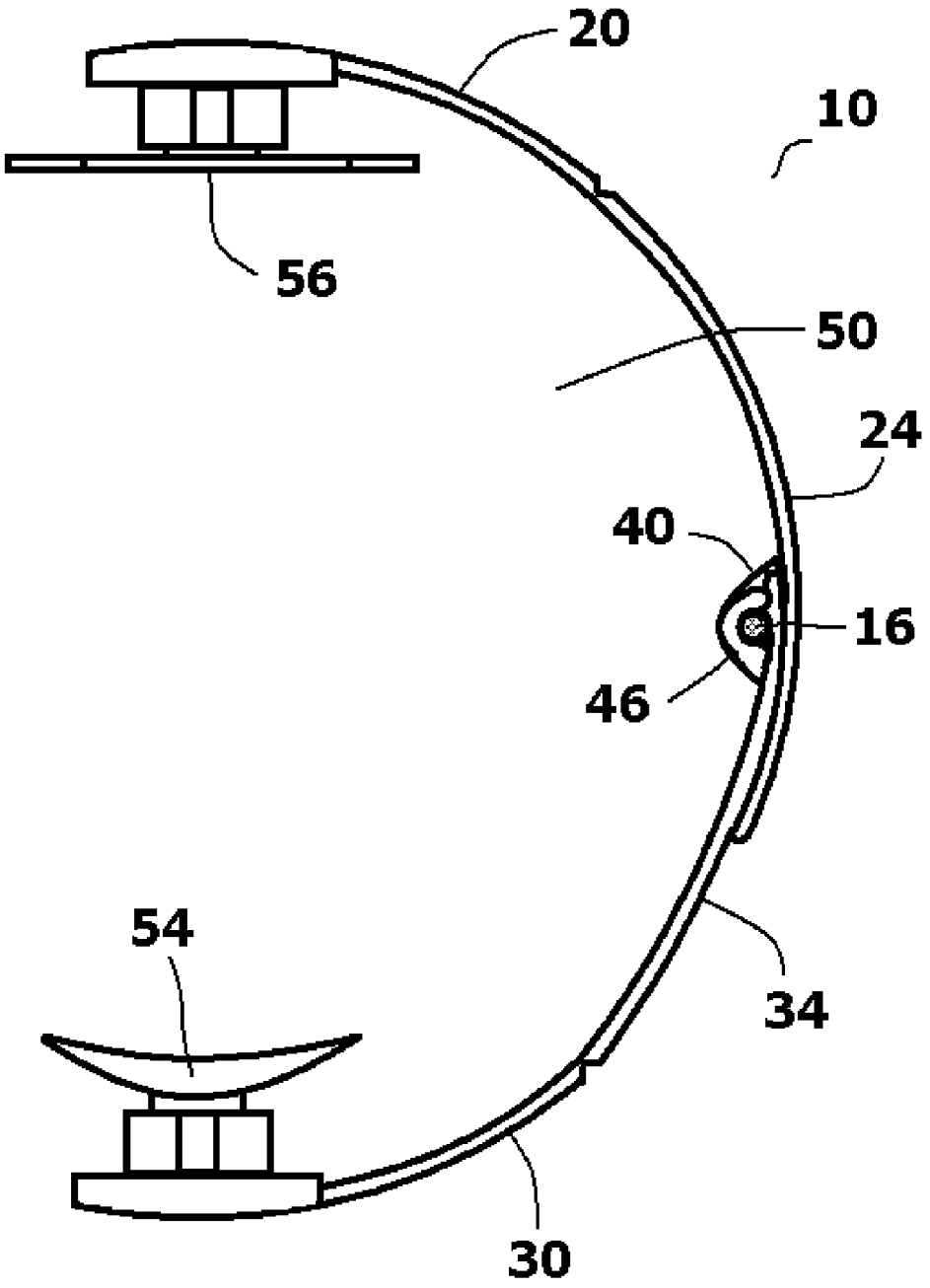
FIG. 7 is a fragmented cross-sectional view of a portion of the exemplary embodiment in its spherical shape.

Referring to FIG. 7 in conjunction with FIG. 6, it will be understood that the resilient ring 16 passes through the hook structures 40, 46 on both the long flaps 24 and the short flaps 34. The resilient ring 16 can be a long metal spring or an elastomeric element. What is important is that the resilient ring 16 be resiliently expandable. In this manner, the resilient ring 16 provides a spring bias that biases the toy assembly 10 into its spherical shaped configuration and resists its movement into its disc shaped configuration.

To convert the toy assembly from its spherical shaped configuration into its disc shaped configuration, a person compresses the first hub 20 and the second hub 30 toward each other. If the applied force overcomes the spring bias of the resilient ring 16, then the toy assembly 10 collapses. As the first hub 20 and the second hub 30 are compressed toward each other, the long flaps 24 and the short flaps 34 flare out in a radial pattern from the hubs 20, 30. This expands the resilient ring 16. The bias force of the expanded resilient ring 16 acts in opposition to the expansion.

Figure 8:
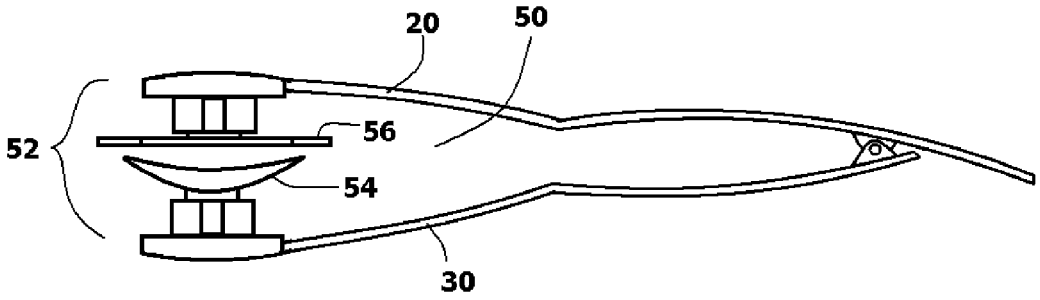
FIG. 8 is the embodiment of FIG. 7 shown partially compressed.

Referring to FIG. 7 and FIG. 8, it can be seen that the toy assembly 10 defines an interior 50. Within the interior 50, a temporary connector 52 is provided. The temporary connector 52 can be any mechanism that can temporarily connect the first hub 20 to the second hub 30 when the first hub 20 and the second hub 30 are pressed together. The temporary connector can be a timed lock, a slip lock, or a tacky connection. In the preferred embodiment, the temporary connector 52 is a suction cup connection.

A suction cup 54 and a flat plate 56 are provided. The suction plate 54 and the flat plate 56 are attached to the interior of the first hub 20 and the second hub 30 in any order. Accordingly, the suction cup 54 can extend inwardly from either the first hub 20 or the second hub 30. The flat plate 56 is coupled to the hub opposite the suction cup 54. In the shown embodiment, the suction cup 54 is attached to the first hub 20 and the flat plate 56 is attached to the second hub 30.

The toy assembly 10 can be flattened into a disc shape by compressing the first hub 20 toward the second hub 30. At the point of optimal compression, the suction cup 54 engages the flat plate 56 and adheres to the flat plate 56. Once the suction cup 54 engages the flat plate 56, the toy assembly 10 is temporarily held in its compressed disc shape. The compressed toy assembly 10 creates a flying disc, as shown in FIG. 5 and FIG. 8.

The resilient ring 16 resists the deformation of the toy assembly 10 into the compressed disc shape. After a period of time, the connection between the suction cup 54 and the flat plate 56 releases. Upon the release, the resilient ring 16 causes the toy assembly 10 to immediately pop back into its original spherical shape. The period of time that the suction cup 54 remains in connection with the flat plate 56 varies depending upon certain factors. The factors include the force with which the suction cup 54 was pressed against the flat plate 56, the cleanliness of the suction cup 54 and the flat plate 56, ambient temperature, ambient humidity, and the latent resiliency of the resilient ring 16. Accordingly, the toy assembly 10 will remain in its disc shape for varying periods of time each time the toy assembly 10 is compressed.

To utilize the toy assembly 10, a user compresses the first hub 20 toward the second hub 30. This causes the toy assembly 10 to change from its ball shaped configuration to its disc shaped configuration. Once compressed, the temporary connector 52 within the toy assembly 10 keeps the toy assembly 10 in its disc shaped configuration for a short period of time. This enables the toy assembly 10 to be thrown like a flying disc. After a short period of time, the temporary connector releases and the toy assembly 10 pops back into its ball shaped configuration. It can be played with as a ball until again being compressed into a disc.

It will be understood that the embodiment of the present invention that is illustrated and described is merely exemplary and that a person skilled in the art can make many variations of the invention using functionally equivalent components. All such variations, modifications, and alternate embodiments are intended to be included within the scope of the present invention.

What is claimed is:

1. A toy assembly that is configurable between a ball shape and a disc shape, said toy assembly comprising:

a first hub;

a first plurality of flaps radially extending from said first hub, wherein said first plurality of flaps are coupled to said first hub with a first set of hinge connections, and wherein said first plurality of flaps has a first set of hook structures formed thereon;

a second hub;

a second plurality of flaps radially extending from said second hub, wherein said second plurality of flaps are coupled to said second hub with a second set of hinge connections, and wherein said second plurality of flaps has a second set of hook structures formed thereon;

a resilient ring that is engaged by both said first set of hook structures and said second set of hook structures, wherein said resilient ring joins said first plurality of flaps to said second plurality of flaps and biases said first plurality of flaps and said second plurality of flaps into said ball shape where said first plurality of flaps partially overlaps said second plurality of flaps, and wherein said first plurality of flaps are joined to said second plurality of flaps only by said resilient ring; and a temporary connector coupled to said first hub and said second hub that temporarily interconnects said first hub and said second hub for a period of time after said first hub and said second hub are pressed together.

2. The assembly according to claim 1, wherein said first plurality of flaps have free ends opposite said first set of hinge connections, wherein a first length exists between each of said first set of hinge connections and each of said free ends along each of said first plurality of flaps.

3. The assembly according to claim 2, wherein each of said first plurality of flaps is curved along said first length.

4. The assembly according to claim 2, wherein each of said first set of hook structures is disposed on each of said first plurality of flaps at a first distance from each of said first set of hinge connections.

5. The assembly according to claim 4, wherein said first distance is between one half and one third of said first length.

6. The assembly according to claim 4, wherein each of said second set of hook structures is disposed on each of said second plurality of flaps at a second distance from said second set of hinge connections, wherein said second distance is equal to said first distance.

7. The assembly according to claim 4, wherein said first hub and said first plurality of flaps radially extending from said first hub are integrally molded as a single piece.

8. The assembly according to claim 4, wherein said second hub and said second plurality of flaps radially extending from said second hub are integrally molded as a single piece.

9. The assembly according to claim 1, wherein said temporary connector includes both a suction cup and a plate.

10. A toy assembly that is configurable between a ball shape and a disc shape, said toy assembly comprising:

a first hemispherical subassembly having a first radius of curvature, a first hub, and a first plurality of flaps that radially extend from said first hub;

a second hemispherical subassembly having a second radius of curvature, a second hub and a second plurality of flaps that radially extend from said second hub, wherein said first radius of curvature of said first hemispherical subassembly is larger than said second radius of curvature;

a resilient ring that is engaged by each of said first plurality of flaps and said second plurality of flaps, therein biasing said first hemispherical subassembly and said second hemispherical subassembly into a ball shape where said first hemispherical subassembly partially overlaps said second hemispherical subassembly wherein said first plurality of flaps is joined to said second plurality of flaps only by said resilient ring; and a temporary connector coupled to said first hub and said second hub that temporarily interconnects said first hub and said second hub for a period of time when said ball shape is altered into a disc shape by compressing said first hub and said second hub together.

11. The assembly according to claim 10, wherein said first plurality of flaps have free ends opposite said first hub, wherein a first length exists between said first hub and each of said free ends along each of said first plurality of flaps.

12. The assembly according to claim 11, wherein each of said first plurality of flaps is curved along said first length.

13. The assembly according to claim 12, further including a first set of hook structures on said first plurality of flaps that engage said resilient ring.

14. The assembly according to claim 13, wherein each of said first set of hook structures is disposed on each of said first plurality of flaps at a first distance from said first hub.

15. The assembly according to claim 14, wherein said first distance is between one half and one third of said first length.

16. The assembly according to claim 14, further including a second set of hook structures on said second plurality of flaps that engage said resilient ring.

* * * * *